United States Patent [19]

Nagel et al.

[11] 4,441,702

[45] Apr. 10, 1984

[54] DEVICE FOR COLLECTING AND STACKING PHOTOGRAPHIC PRINTS

[75] Inventors: Erich Nagel, Ansing; Rainer Türcke, Munich, both of Fed. Rep. of Germany

[73] Assignee: Agfa-Gevaert AG, Leverkusen, Fed. Rep. of Germany

[21] Appl. No.: 206,858

[22] Filed: Nov. 7, 1980

Related U.S. Application Data

[63] Continuation of Ser. No. 971,371, Dec. 20, 1978, abandoned.

[30] Foreign Application Priority Data

Dec. 23, 1977 [DE] Fed. Rep. of Germany ..... 2757849

[51] Int. Cl.[3] ..... B65H 29/42; B65H 29/38

[52] U.S. Cl. ..... 271/177; 271/179; 271/178; 271/180

[58] Field of Search ..... 271/177, 178, 179, 180, 271/181; 414/48, 49, 106, 107, 108, 109; 53/542, 520

[56] References Cited

U.S. PATENT DOCUMENTS

| | | | |
|---|---|---|---|
| 932,283 | 8/1909 | Johnson | 271/178 |
| 1,912,565 | 6/1933 | Brown | 271/179 |
| 2,769,495 | 11/1956 | Pomper et al. | 271/177 |
| 3,052,467 | 9/1962 | Fertig | 271/177 |
| 3,302,948 | 2/1967 | May | 271/177 |
| 3,365,193 | 1/1968 | Davis | 271/178 |
| 3,501,893 | 3/1970 | Peterson | 53/573 |
| 3,847,382 | 11/1974 | McKee | 271/179 |
| 4,056,264 | 11/1977 | Dhooge et al. | 271/177 |
| 4,065,123 | 12/1977 | Arrasmith et al. | 271/178 |
| 4,114,349 | 9/1978 | Jensen et al. | 53/520 |

FOREIGN PATENT DOCUMENTS

| | | | |
|---|---|---|---|
| 445146 | 2/1949 | Italy | 271/178 |

*Primary Examiner*—Bruce H. Stoner, Jr.
*Assistant Examiner*—James E. Barlow
*Attorney, Agent, or Firm*—Michael J. Striker

[57] ABSTRACT

The device comprises a container defining an inlet opening, an input area in alignment with the inlet opening and a stacking area adjoining the input area. A feeding mechanism, such as two pairs of worm conveyors, a pair of frictional rollers, a conveyor belt, a vane shaft and the like, is arranged in the input area near the inlet opening to transfer a print at an accelerated speed from the inlet area into the stacking area.

1 Claim, 8 Drawing Figures

DEVICE FOR COLLECTING AND STACKING PHOTOGRAPHIC PRINTS

This is a continuation of application Ser. No. 971,371, filed Dec. 20, 1978 now abandoned.

BACKGROUND OF THE INVENTION

This invention relates generally to a device for collecting and stacking photographic prints, and more particularly it relates to stacking paper prints discharged from a cutting apparatus, the device having a container provided with an inlet opening through which the paper prints are fed by a mechanical feeding device or by the force of gravity.

The cut photographic paper prints as known are susceptible to bending or twisting and consequently the stacking of such deformed prints is impeded. Stacking devices are known from prior art in which the cut photographic prints are consecutively collected by having their flat sides fall one upon the other. In this prior art stacking devices, the prints are generally moved in a horizontal or inclined frame. The disadvantage which the user encounters is, however, the fact that since the prints fall on the stack with their flat sides oriented downwardly, the speed of falling is relatively very slow. As a consequence, when the stacking device is fed from a high-speed cutting device which nowadays is commonly used, a print frequently has not yet discharged from the input range of the stacking device when the next print is arriving and the danger of jamming arises. The same situation occurs also in the case of inclined feeding plane for the prints.

In the event that the feeding of prints is directed from above downwardly as it is nowadays most desirable for the sake of space-saving, the incoming print usually remains standing below the input opening of the stacking container and due to its arched shape usually blocks the way for the next print.

SUMMARY OF THE INVENTION

It is, therefore, a general object of the present invention to overcome the aforementioned disadvantages.

More particularly, it is an object of the invention to provide an improved device for collecting and stacking photographic prints which insures a faster and jam-free input of incoming photographic prints.

Another object of the invention is to provide such an improved device which is simple in structure and inexpensive in manufacture.

In keeping with these objects, and others which will become apparent hereafter, one feature of the invention resides, in a device for collecting and stacking photographic prints of the above-described type which comprises a container having an inlet opening adapted for receiving the prints and an interior defining an input area which is generally in alignment with the inlet opening and a stacking area adjacent the inlet area, and feeding means arranged in the input area in the range of the inlet opening for discharging at a higher speed the incoming prints into the stacking area.

The invention makes it possible that the input area within the stacking container is always kept clear whereby the position of the container with respect to the direction of feeding of the prints can be arbitrary. In this manner, the stacking speed is matched to the speed of discharge of the prints from the cutting apparatus.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIGS. 2–7 show in sectional side views different modifications of the collecting and stacking device of FIG. 1, in which FIG. 2 illustrates a feeding device in the form of a vane wheel;

FIG. 3 shows a feeding device with a rake-like flap;

FIG. 4 shows a feeding device in the form of a pneumatic nozzle;

FIG. 5 shows a feeding device in the form of a conveyor belt;

FIG. 6 shows a pair of feeding rollers;

FIG. 7 is a feeding device employing two feeding rollers in cooperation with a spring biased press pad.

DESCRIPTION OF THE PREFERRED EMBODIMENTS

Figure 1:
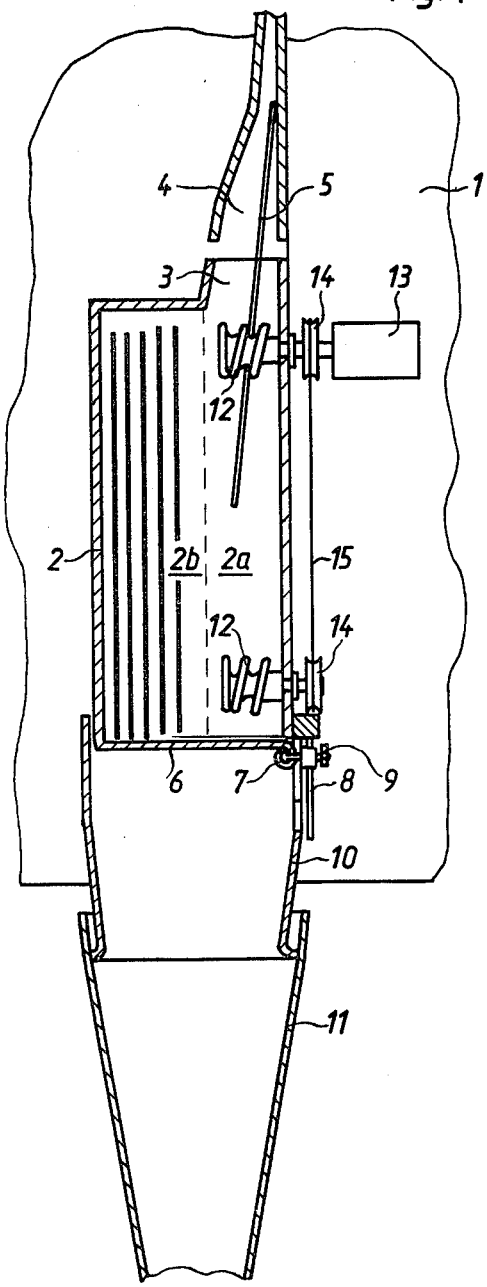
FIG. 1 is a sectional side view of one embodiment of the device of this invention shown in connection with the outlet of a cutting device and a funnel or chute for a packing envelope.

Referring first to FIG. 1, the device of this invention includes a container 2 for collecting and stacking the cut paper prints. Container 2 is suspended in a vertical position on a mounting plate 1. The top surface of the container has an inlet opening 3 which communicates with discharge channel 4 of a cutting and sorting device that is non-illustrated. Preferably, channel 4 is directed vertically so that photographic print 5 enters inlet opening 3 of the container 2 in a substantially vertical position.

The interior of container 2 has two ranges or areas, namely an input area 2*a* situated below the inlet opening 3 and a stacking range or area 2*b* adjoining the inlet area. The bottom side of container 2 is free and is closed by a swingable flap 6 which is pivotably supported for rotation about a pivot axis 7 and is vertically adjustable along guiding rod 8 to which it is secured by means of clamping element 9 so that the vertical dimension of the available space in container 2 can be adjusted according to the size of the processed prints.

The lower part of container 2 is extended by a chute or funnel 10 which is secured to the outer walls of the container and to the outlet of which an order envelope in its extended condition is secured by suitable fastening means (not shown).

Figure 8:
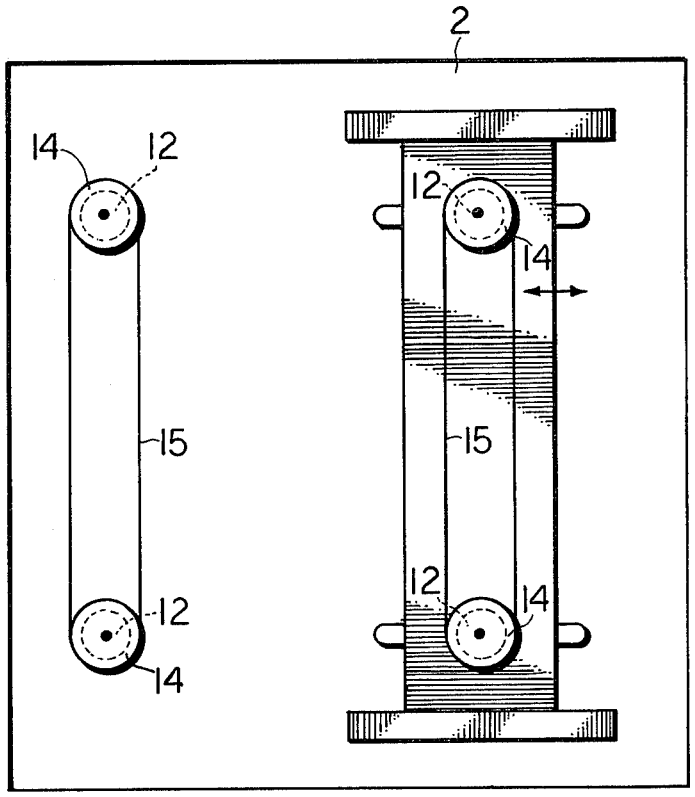
FIG. 8 is a rear view of the embodiment of FIG. 1.

According to this invention photographic print 5 arriving at a certain speed through inlet opening 3 in container 2 is to be driven out as fast as possible from input area 2*a* in the container into the adjacent stacking area 2*b*. As illustrated in FIG. 8, two pairs of worm conveyors or feeding screws 10 are arranged in the input area 2*a* in such a manner that the screws 12 engage opposite side edges of the incoming print 5. Accordingly, two feed screws 12 are located at an upper level of the input area 2*a* of container 2, whereas another pair of similar feed screws is located at a lower level of the input area 2a in the proximity of flap 6. One of feed screws 12 is positively coupled to a drive 13 and the axle of each screw 12 is provided with driving disc 14 interconnected by driving belt 15 so that drive 13 rotates simultaneously all four screws.

In operation, an order envelope 11 is first automatically or manually attached to the outlet or funnel 10 and a starting signal is applied to the cut photographic paper prints pertaining to the processed order. Thereupon, paper prints discharged through channel 4 of the cutter at a relatively high speed enter opening 3 and lateral edges of the prints are engaged by the threads of rotating feed screws 12. The drive of feed screws 12 is controlled in such a manner that the rotation of the screws is initiated only when the print 5 is in engagement with all four screws 12. As soon as feed screws 12 start rotating the paper print has come into engagement with all four screws 12 is quickly discharged by the rotating threads from the input area 2a into stacking area 2b and the former area is cleared for receiving the subsequent print. The mutual spacing of feed screws 12 is adjustable preferably by means of a non-illustrated adjustment mechanism so that the feed screws might be employed for prints of different format. Also the vertical position holding clamp 9 on guiding rod 8 is adjusted such that the distance of flap 6 from the top wall of container 2 is slightly larger than the vertical dimension of the processed print.

Instead of respective feed screws it is also possible to employ a pair of rollers or wheels arranged side-by-side for rotation about parallel axles extending in the feeding direction perpendicularly to the side edges of the paper prints, the rollers in each pair being slightly spaced apart from one another and the gap between the rollers guiding the introduced prints. When the feeding rollers start rotating the print is discharged into the stacking area 2b in the same manner as described above.

FIGS. 2–7 illustrate schematically different variations and modifications of the device according to this invention. These embodiments have different print feeding mechanisms and/or different configurations of their collecting containers, but all having the common feature in forwarding the print from the input area into the stacking area at a higher speed than the speed of the cutting machine. In the embodiment shown in FIGS. 2–7, the reference numerals corresponding to like parts in the embodiment of FIG. 1 have been omitted.

Figure 2:
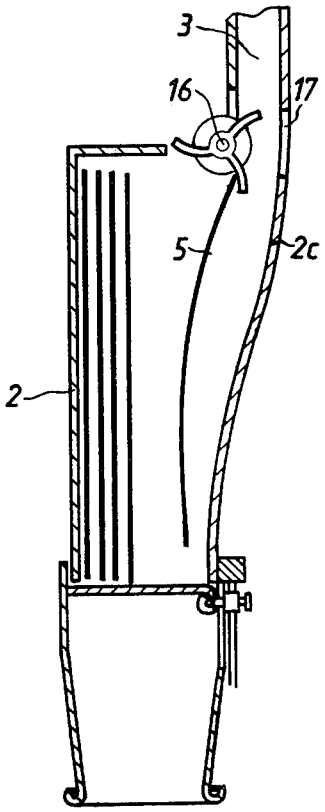

FIG. 2 shows an embodiment in which the feeding device in the form of vane wheel 16 is arranged for rotation in the range of inlet opening 3. The vanes of wheel 16 have a rake-like shape and are slightly arched. The portion 17 of wall 2c opposite vane wheel 17 is recessed so that the tips of vanes can enter the recess. In addition, wall 2c can be slightly curved to have a downwardly tapering profile.

As soon as paper print 5 lands in the intake area 2a adjoining the inwardly curved wall 2c, the concave surfaces of vanes of rotating wheel 16 engage the top edge of print 5 and displace the same into the joining stack area 2b. According to the height adjustment of the bottom flap 6, print 5 is slightly arched during its engagement with the tips of the vanes so that upon releasing of pressure exerted by the vanes, the deformed print 5 due to its own resiliency springs forwardly into the stacking area 2b of the container.

Figures 3, 4, 5, 6:
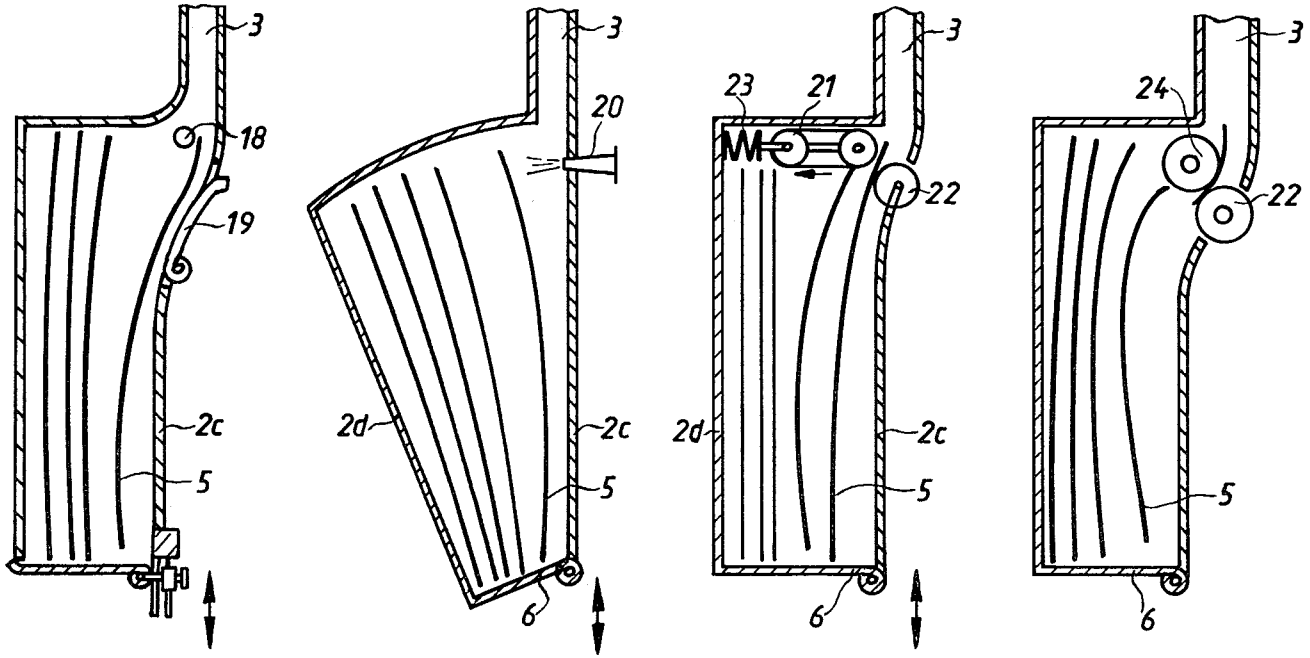

A similar effect is achieved in the embodiment of FIG. 3. In this embodiment, the inlet opening 3 is provided with a cross bar 18 in the form of a round rod which extends parallel to the top edge of print 5 when the latter reaches the bottom of input area 2a. Round bar 18, therefore, prevents the print from tilting into the stacking area. A rake-like flap 19 which is tiltably supported in wall 2c below the level of bar 18 is then actuated by a non-illustrated drive mechanism and pushes the prints into the stacking area 2b. As soon as print 5 reaches the bottom flap 6, the rake-shaped feeding flap 19 starts tilting inwardly and first urges the top portion of the print against the bar 18. During the further movement of feeding flap 19, the upper part of print 5 is pressed under the bar 18 so as to deform into an arch and thereupon the thrust of feeding flap 19 is abruptly interrupted. In the range below the bar 18 the print due to its own resiliency resumes its straight form and jumps into the stacking area 2b.

Another embodiment is illustrated in FIG. 4 where a nozzle 20 is arranged in the upper range of the rear wall 2c below the inlet opening and is connected to a non-illustrated pressure aire conduit. The opposite wall 2d in the range of the stacking area as well as the bottom flap 6 are inclined relative to the inlet wall 2c so that prints 5 discharged through inlet opening 3 are automatically filed in stacking area 2b. To accelerate this filing action an intermittent short blow of pressure air is blown from nozzle 20 against the upper part of each print 5 so that the input area 2a below feeding opening 3 is always kept free.

In FIG. 5 container 2 is illustrated having rectangular walls and a feed mechanism in the form of a conveyor belt 21 arranged below the top wall of the container and cooperating with a counteracting roller 22 which is arranged in the range of inlet opening 3 opposite conveyor 21. The support for the two rollers of conveyor belt 21 is used against the counteracting roller 22 by means of a pressure spring 23.

Print 5 after passing through inlet openings 3 is forwarded by conveyor belt 21 and the counteracting roller 22 into the input area 2a. By adjusting the vertical position of bottom flap 6 with respect to the format of the prints it is attained that the print resting on bottom flap 6 reaches with its upper edge the lower run of conveyor belt 21. The vertical position of bottom flap 6 is, therefore, to be adjusted such that the distance between the bottom flap and the lower run of conveyor belt 21 is slightly smaller than the height of the print. As a consequence, print 5 is again slightly arched and in this position is forwarded against the stack of prints in stacking area 2b.

An embodiment similar to that as shown in FIG. 5 is illustrated in FIG. 6. Instead of a conveyor belt there is provided a frictional roller 24 which cooperates with a counteracting roller 22 driven by a non-illustrated driving member. As in the preceding example, the distance of the lower part of frictional roller 24 from bottom flap 6 is slightly smaller than the length of print 5.

Paper print fed through inlet opening 3 is first brought between rollers 22 and 24 and transferred downwardly until it abuts against the bottom flap 6. By virtue of the reduced distance of the lower part of friction roller 24 from the bottom of the container, the upper part of the print is taken along in the direction of rotation of frictional roller 24 and during this movement the print is first arched and partially displaced from the inlet area 2a. Immediately after the shifting of the upper part of print 5 past the lowest point of rollers 24, the deformed print 5 due to its own elasticity springs up to its original form and jumps into the stacking area 2b. In this manner, the print is very quickly removed from the inlet area 2*a*. In order that the arching of the print could occur below the frictional roller 24 the axis of the driven contacting roller 22 has to be situated a little lower than the axis of frictional roller 24. Frictional roller 24 is preferably provided with a rubber lining so as to insure a reliable displacement of the upper edge of the print.

Figure 7:
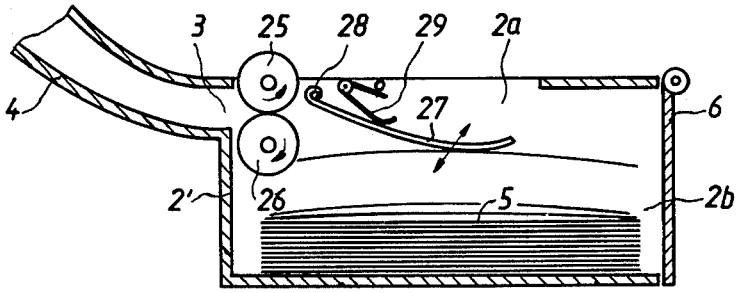

In FIG. 7, container 2' is illustrated in which prints 5 are stacked in a horizontal position or slightly inclined to a horizontal plane. This horizontal orientation of container 2' is preferable in the case when prints after cutting are excessively arched or twisted. In this embodiment bottom flap 6 forms a side wall of the container and its distance from the feeding mechanism 25 and 26 can be adjusted in the same manner as in the preceding examples. The inlet area 2*a* now takes place in the upper range of the container 2' and the stacking area is in the lower range thereof. Channel 4 communicating with the inlet opening 3 can be bent up toward a sorting point. Feeding means in the form of a pair of conveyor rollers 25 and 26 are again situated in the range of the inlet opening 3 but the distance between the feeding mechanism and flap 6 is in this case larger than the length of processed prints. A spring-biased press pad 27 is arranged downstream in the feeding path behind the feeding rollers 25 and 26. This press pad is pivotable about axis 28 and spring 29 urges the pad perpendicularly to the direction of the print feeding.

Print 5 is relatively vigorously accelerated by the pair of transport rollers 25 and 26 and discharged in a substantially horizontal plane against the tiltable flap 6 whereby the lowering pad 27 is lifted by the accelerated print. Upon abutment of print 5 against flap 6 the print bounces back against the lower transport roller 26. This slightly downwardly directed backward movement is further enhanced by pressure pad 27. After abutting against the lower transport roller 26 and due to the rotation of the latter print 5 receives a downward impulse and lands on the underlying stack of prints. The spring-biased pad 27 prevents the arched uppermost print on the stack from projecting into the inlet area 2*a* and thus from disturbing the feeding process. The embodiment of FIG. 7 has the advantage in comparison to that of FIG. 1 in that no adjustment of the size of the container is necessary even if different formats of prints are handled. In all shown embodiments there is provided also a mechanical discharger (not illustrated) by means of which prints pertaining to one order are discharged through the swung-open flap 6 into the order envelope held below the discharge opening from container 2.

It will be understood that each of the elements described above, or two or more together, may also find a useful application in other types of constructions differing from the types described above.

While the invention is illustrated and described as embodied in a device for collecting and stacking photographic prints, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A device for collecting and stacking photographic print, particularly paper prints discharged from a cutting apparatus, comprising a container having an inlet opening adapted for receiving said prints, an interior defining an input area in alignment with said inlet opening, a stacking area adjoining said inlet area, and an outlet opening; feeding means arranged in said input area for accelerating the incoming prints and discharging them into said stacking area at an increased speed; a tiltable flap arranged at said outlet opening to hold the prints in, and alternatively, to release the prints from said stacking area; and means for adjusting the position of said flap relative to said outlet opening according to different sizes of said prints; said inlet opening being arranged in a lateral wall of said container to feed said prints in a direction which is parallel to the outlet opening of said container, said feed means including a pair of contacting rollers driven for discharging each print at an increased speed against the opposite wall of said container, said opposite wall being spaced apart from said feed means at a distance which is larger than the length of said prints, the top wall of said container supporting a tiltable press pad which is spring-biased for urging each print after its rebouncing from said opposite wall towards said stack of prints.

* * * * *